United States Patent [19]

Graziano

[11] 4,159,553

[45] Jul. 3, 1979

[54] CONTINUOUS PROCESS FOR DECONTAMINATING AND CLEANING THE OUTER SURFACE OF PLASTIC CONTAINERS TO PERMIT PRINTING THEREON

[76] Inventor: Sinibaldo Graziano, 516 Front St., Union Beach, N.J. 07735

[21] Appl. No.: 827,121

[22] Filed: Aug. 24, 1977

[51] Int. Cl.[2] ..... B67C 1/00

[52] U.S. Cl. ..... 15/101

[58] Field of Search ..... 15/4, 21 A, 56, 59, 15/62, 65, 66, 70, 88, 97 R, 101, 104.04

[56] References Cited

U.S. PATENT DOCUMENTS

| | | | |
|---|---|---|---|
| 1,589,839 | 6/1926 | Conklin | 15/21 A |
| 3,928,883 | 12/1975 | Gregory | 15/88 X |

*Primary Examiner*—Edward L. Roberts

*Attorney, Agent, or Firm*—Howard T. Jeandron

[57] ABSTRACT

A continuous apparatus for cleaning and decontaminating the glasslike outer surface of plastic containers to prepare them for printing thereon is provided by a pair of troughs designed to retain the containers, one trough as a feeder trough down which the containers slide or roll to meet the second trough, the second trough receiving the containers one by one and the trough provided with a continuously driven pusher piston to move the containers one by one the exact length of the container, said containers moving along said trough and passing through first a lined trough having a wiping toweling surround the container and the toweling connected to a decontaminating fluid tank, a second portion of said trough surrounded with dry toweling to wipe said containers as they are pushed along said trough until the container reaches the end clean and ready for printing on the surface of said container.

3 Claims, 3 Drawing Figures

Figures 1, 2, 3:
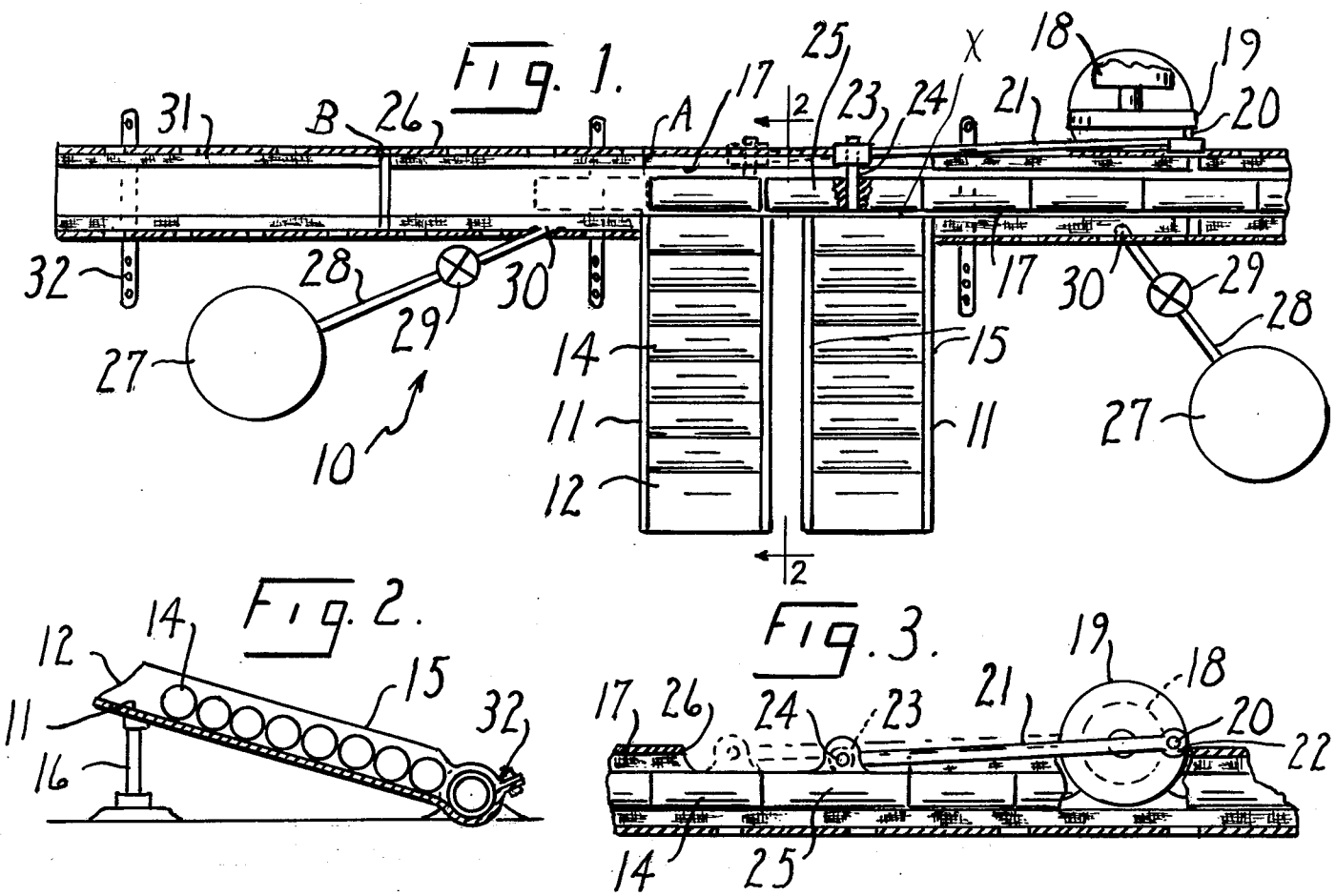

CONTINUOUS PROCESS FOR DECONTAMINATING AND CLEANING THE OUTER SURFACE OF PLASTIC CONTAINERS TO PERMIT PRINTING THEREON

This invention relates to a cleaning and decontaminating process for the outer surface of plastic containers to prepare them for printing on said surface.

In the treatment and cleaning of the outer surface of smooth hard plastic containers to prepare them for printing on their outer surface, hand washing is not fast enough and not thorough as many containers are rejected after printing thereon, due to blemishes or failure to provide a perfectly clean surface to print thereon.

A print upon a hard smooth plastic surface is never attempted until the surface is absolutely clean. Doing this by hand is a slow process and liable to provide many rejects and is not acceptable.

It is well known that many of the hard, smooth glass-like plastic containers used today, to hold various products, do not provide a good clean surface for printing and are usually provided with a stick on label. Many of these labels are not securely affixed and are lost.

It is an object of this invention to provide a continuously operating machine having a downwardly sloped container slide for charging or feeding the containers and in which the containers lie in an abutting relationship in a straight line moving downward to a trough, said trough being of a contour to accept the containers being charged therein so that one container at a time will be accepted, and said straightline trough extending outward at right angles to the slide. A motor driven piston fitted to said trough and cycled to move in one direction a distance equal to the length of one container at a time as they are cleansed and then return to its original position to allow the next container in the slide to drop into the trough to be similarly moved by the continuously operating piston. Said trough passing into a pipelike extension in which the containers are pushed through. Said pipelike extension lined with a liquid absorbing material, such as cloth, that is saturated with a cleaning solution, such as alcohol, and a fluid feed from a reservoir holding said cleaning solution, said fluid feed being directed to said absorbent material to thus assist in thoroughly wiping and cleaning the exterior surface of said containers as they move through said pipelike extension. A further pipelike extension similar to the first cleaning portion and connected thereto to receive the containers as they are pushed outward from the charging, feeding slide. Said second pipelike extension similarly lined with a liquid absorbing material to wipe and absorb the cleaning solution from the surface of the containers to insure a dry surface as the containers are propelled from the trough, to a packing bag, box or container to be forwarded for printing.

It is an object of this invention to provide a proper continuous movement of the plastic containers through said machine while being cleaned in the first step and wiped and dried in the second step to prepare them for shipment for printing on said outer surface in the third step.

The complete operation is without manual assistance except for loading the input shoot and removing at the output.

Further objects may be apparent by reference to the following detailed description and the drawings in which FIG. 1 is a plan view of the machine, FIG. 2 is a side view taken on line 2—2 of FIG. 1, and FIG. 3 is a front view of the drive motor and linkage partly in section.

Referring to the drawings there is illustrated in FIG. 1 a washing and cleaning and drying apparatus for small plastic containers 14 to prepare them for printing thereon. The apparatus 10 comprises a slide 11 with a trough 12 wide enough to retain the containers 14 and having sides 15 to keep the containers in line. The slide 11 is supported at its upper end by a jack 16, thus permitting adjustment of the slide to a proper angle to insure the automatic sliding of the containers downward to a trough 17, that is lengthwise at right angles to the slide 11. The trough 17 is of a size to accept the container and keep it within the trough, in spite of the pressure exerted by the next container. The trough 17 extends in both directions at right angles to the slide 11.

Referring to FIG. 3 there is illustrated the motor drive to produce the necessary movement of the containers 14 along the trough 17. A motor 18 drives a cam plate 19 clockwise. Cam plate 19 has a drive pin 20, an arm 21 is attached to pin 20 with a bearing 22 fitted to pin 20 so that arm 21 can be driven back and forth in a continuing cycle. Arm 21 at its opposite end has a bearing 23 that is fitted to a pin 24. Pin 24 extends from a pusher block 25. Block 25 fits in trough 17 and is positioned to abut with each container 14 when the container drops into the trough 17. Thus there is a continuous feed of containers 14 from slide 11 that will be dropped into the trough 17, and the pusher block 25 will, in a continuous cycle, push each container a distance equal to the length of the container. Thus it is apparent that the containers will move along the trough 17 in a continuous abutting relationship. The trough 17 is lined with an absorbent material 26 from a position A to B, so that the containers move through this material in a wiping movement. A tank 27 filled with a cleaning solution such as alcohol is positioned adjacent to the trough 17 and the outlet 28 of the tank is provided with a valve 29. The opposite side of the valve 29 is connected by a pipe 30 to the absorbent material 26 in the trough between A and B. Thus by means of valve 29 the flow or the degree of saturation of the material 26 can be controlled. When the containers 14 move away from the absorbent material 26 where they have been wiped clean, they are again wiped by a dry liner or towellike lining 31 to remove all moisture or any remaining foreign substance of powder so that when the container reaches the discharge end of the trough 17 it is clean and dry and ready for printing on its surface.

Due to the fact that there will be containers of a different size that may be similarly treated, the trough 17 is constructed of a bendable sheet metal (perforated) and is shown open at the top, FIG. 1. The trough 17 is retained in a circular form by clamps 32, (FIG. 2) along the length of the trough. Thus the clamps can be adjusted to the size containers being cleaned.

Although we have shown and described one side of this operation, the apparatus may be duplicated, that is, a similar slide 11 may be positioned alongside of the slide shown so that the containers 14 will be charged into trough 17 at a point x, thus on each return stroke of 25, a container will be pushed to the right. The trough 17 will be duplicated on this side, as shown on the right side.

The invention described in detail in the foregoing specification is subject to changes and modifications without departing from the principle and spirit thereof. The terminology used is for purposes of description and not of limitation; the scope of the invention being defined in the claims.

What is claimed is:

1. A round container continuously operated cleaning and decontaminating machine, comprised of a gravity feed trough designed to retain a plurality of particularly sized containers in aligned abutting rolling relationship, said gravity feed trough connected to an abutting level extended carrier trough at its lower exit, said abutting and level extended carrier trough being of a round shape with a feed portion to accept said containers one by one, a cyclely operated pusher piston fitted to said carrier trough to move said containers one at a time to the left the length of said container to thus permit the next container to drop into said carrier trough when the piston retracts in its cycled continuous operation, said containers pushed outward from said initially charged position along said carrier trough, said carrier trough lined along a portion of its length with an absorbent resilent material such as toweling, said lined trough divided into two separated portions, a first portion being positioned adjacent said feed trough, a tank containing a cleaning solution such as alcohol connected to the first portion of said lined trough with a gravity feed and having a valve to control the fluid flow, a second portion of said lined trough separated from said first portion and provided with a dry absorbent material to wipe said containers clean and dry, said containers being ejected from the end of said trough by the movement of the pusher piston.

2. In a device according to claim 1 in which a duplicate second gravity feed trough is positioned in parallel relationship to said first gravity feed trough and spaced from said first gravity feed trough to feed said containers to the opposite side of said pusher piston in said carrier trough when said piston reaches its extended position in moving said containers to the left, said containers dropping one by one from said second feed trough into said aligned carrier trough to be pushed to the right along said carrier trough, said carrier trough similarly lined along two portions of its length with an absorbent resilient material such as toweling, said trough duplicating said first carrier trough with a gravity feed and valved line to said first portion of toweling and said containers ejected from said trough one by one.

3. A round container continuously operated cleaning and decontaminating machine, comprised of two gravity feed troughs designed to retain a plurality of particularly sized containers in each trough in aligned abutting rolling relationship, said gravity feed troughs connected to abutting level extended carrier troughs being of a round shape with two feed portions to accept said containers one by one, a cyclely operated pusher piston fitted to said carrier trough in front of said feed troughs to move back and forth blocking one trough while the other trough is open to allow a container to drop into said trough and vice versa and said pusher piston moving said containers the length of one container one at a time to the left in one trough, to the right in the other trough to thus permit the next container in each trough to drop into said carrier troughs when the pusher piston retracts in its cycled continuous operation, said containers pushed outward from said initially charged position along said carrier troughs, said carrier troughs lined along a portion of their length with an absorbent resilient material such as toweling, said lined troughs divided into two separated portions, a first portion being positioned adjacent said feed trough, a tank containing a cleaning solution such as alcohol connected to the first portion of both of said troughs with a gravity feed and having a valve to control the fluid flow, a second portion of said lined troughs separated from said first portion and provided with a dry absorbent material to wipe said containers clean and dry, said containers being ejected from the end of said troughs by the movement of the pusher piston.

* * * * *